US008486230B2

(12) United States Patent
Inoue et al.

(10) Patent No.: US 8,486,230 B2
(45) Date of Patent: Jul. 16, 2013

(54) SHOE PRESS BELT

(75) Inventors: Hideo Inoue, Tokyo (JP); Tomoyuki Kawamata, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 13/257,718

(22) PCT Filed: Apr. 9, 2010

(86) PCT No.: PCT/JP2010/002595

§ 371 (c)(1),
(2), (4) Date: Sep. 20, 2011

(87) PCT Pub. No.: WO2010/116755

PCT Pub. Date: Oct. 14, 2010

(65) Prior Publication Data

US 2012/0012270 A1 Jan. 19, 2012

(30) Foreign Application Priority Data

Apr. 10, 2009 (JP) ..... 2009-095908

(51) Int. Cl.
*D21F 3/00* (2006.01)

(52) U.S. Cl.
USPC ..... 162/358.4

(58) Field of Classification Search
USPC ..... 162/358.4, 358.2, 901; 428/167
See application file for complete search history.

(56) References Cited

U.S. PATENT DOCUMENTS

| | | | | |
|---|---|---|---|---|
| 3,600,779 | A * | 8/1971 | DeNoyer | 492/33 |
| 5,543,015 | A * | 8/1996 | Jermo | 162/358.4 |
| 6,296,738 | B1 | 10/2001 | Ishii | |
| 6,416,630 | B1 | 7/2002 | Matuschczyk et al. | |
| 7,540,942 | B2 * | 6/2009 | Hikita | 162/358.4 |
| 7,918,971 | B2 * | 4/2011 | Takano | 162/358.4 |
| 8,262,864 | B2 * | 9/2012 | Takamura | 162/358.2 |
| 8,282,784 | B2 * | 10/2012 | Takano et al. | 162/358.4 |
| 2004/0112561 | A1 | 6/2004 | Watanabe et al. | |
| 2010/0101746 | A1 | 4/2010 | Takano et al. | |

FOREIGN PATENT DOCUMENTS

| | | |
|---|---|---|
| JP | 11 335992 | 12/1999 |
| JP | 2001 98484 | 4/2001 |
| JP | 2002 327389 | 11/2002 |
| JP | 3749256 | 12/2005 |
| JP | 2007 074956 | * 3/2007 |
| WO | 2007 042623 | 4/2007 |
| WO | 2008 123026 | 10/2008 |

OTHER PUBLICATIONS

International Search Report Issued May 27, 2010 in PCT/JP10/002595 Filed Apr. 9, 2010.

* cited by examiner

*Primary Examiner* — Mark Halpern

(74) *Attorney, Agent, or Firm* — Oblon, Spivak, McClelland, Maier & Neustadt, L.L.P.

(57) ABSTRACT

A belt (shoe press belt) for papermaking machines having good wet paper web water squeezing capability, and wherein damage, cracks, and abrasion of the outer circumferential belt surface during use is small, and due to the reduced abrasion between the cutting chips, the cutter and the groove walls, the cutter life is long and the surface roughness is small. The cross-section in the cross-machine direction of the water draining grooves is provided in the machine direction in the felt-side surface of the shoe press belt and the groove corner parts formed by the groove sidewalls and the groove bottom part of the water draining grooves are chamfered in the shape of a trapezoid or a rectangle.

8 Claims, 3 Drawing Sheets

SHOE PRESS BELT

This application is a 371 of PCT/JP2010002595 filed 9 Apr. 2010

TECHNICAL FIELD

The present invention relates to a shoe press belt (hereinafter also referred to as "belt") used for improving the water squeezing capability from a wet paper web and a felt in the press part of a papermaking machine or a similar machine, and more particularly to the groove configuration provided in the felt-side surface of the shoe press belt.

BACKGROUND ART

In papermaking, the question of how to increase the dewatering amount from the wet paper web in the press part in order to improve productivity is an important issue. The means adopted for increasing the dewatering amount of the press part include: raising the pressure applied by the press roll, increasing the hardness of the press roll, and other methods; among these, the method of improving the dewatering effect by interposing a shoe press belt to extend the time during which pressure is applied between the roll and the felt during pressing has become widespread in recent years.

Recently, the number of shoe press belts has also increased, in which a plurality of grooves is provided in the felt-side surface for efficiently draining the squeezed water. For example, the press belt in FIG. 1 (according to Patent document 1) is a shoe press belt in which the water draining effect has been boosted by providing a plurality of grooves in the felt surface. The groove configuration of this shoe press belt is made to prevent the occurrence of cracks in the bottom corner parts of the groove by providing a smooth transition rotundity between the two sidewalls, diverging upward towards the opening region, and the groove bottom part.

Regarding the press jacket in FIG. 2 (Patent document 2), the press jacket is provided with a plurality of grooves and/or blind holes wherein the sidewalls are provided, in the opening region, with an inclined surface and/or a spherical section extending along a prescribed curve in order to prevent a reduction of the volume when a compression load is applied.

The shoe press belt of FIG. 3 (Patent document 3) is characterized in that, in a belt for carrying a felt for squeezing water from a wet paper web between a press roll and a shoe, water drain grooves are provided in the felt-side surface of the shoe press belt which is pressed under high pressure when it approaches the press roll; wherein the groove configuration has outwardly curved sidewalls.

The shoe press belt in FIG. 4 (Patent document 4) is characterized in that, for preventing the occurrence and development of cracks, the bottom of the water drain grooves 9a in the end part-adjoining region S3 in the axis direction, which comprises either one of the end part-adjoining region S2 in the axis direction of the press shoe 10 or the end part-adjoining region S1 in the axis direction of the press roll 11, penetrates further to the reinforcing layer 12 than the bottom of water drain grooves 9b in regions other than the end part-adjoining region S3.

CITATION LIST

Patent Literature

[Patent document 1] JP, B, 3749256
[Patent document 2] JP, A, 11-335992

[Patent document 3] JP, A 2001-98484
[Patent document 4] JP, A 2002-327389

SUMMARY OF INVENTION

Technical Problem

Having conducted extensive research in the technical field of the invention, the present inventor faced the problem that, when, in a shoe press belt wherein water drain grooves are provided in the machine direction (MD) in the surface on the felt side of the shoe press belt, the groove walls and land parts or groove bottom part are directly connected by flat surfaces, cracks tend to occur in the connecting parts during the use of the belt. Moreover, when the groove walls and groove bottom are in the shape of a curved surface, there is the problem that the cutting chips, occurring during groove cutting, stay inside the groove part and the cutter and groove walls scratch and rub against each other due to these cutting chips; as a result of which the cutter is damaged during cutting, the operational life of the cutter is reduced, and the surface roughness of the cut groove surfaces increases. When the surface roughness increases, the discharge performance of the discharge openings is reduced; this can be a cause for damage to the groove wall surfaces, the bottom part and the top parts during belt operation.

Having reflected upon these problems, the object of the present invention is to provide a belt (shoe press belt) for papermaking machines having good wet paper web water squeezing capability, and wherein damage (cracks and abrasion) of the outer circumferential belt surface during use is small, and due to the reduced abrasion between the cutting chips, the cutter and the groove walls, the cutter life is long and the surface roughness is small.

Solution to Problem

The present inventors discovered that the above mentioned problems can be solved by a shoe press belt, wherein the cross-section in the cross-machine direction (CMD) of the water drain grooves is formed in the shape of a trapezoid or a rectangle and the groove corner parts formed by the groove sidewalls and the groove bottom part are chamfered, and thus completed the invention.

The present invention basically relates to a shoe press belt for papermaking, wherein the cross-sectional shape of water drain grooves is designed in the cross-machine direction (CMD); the invention is based on the technologies hereinafter.

(1) A shoe press belt for papermaking disposed between a press roll and a shoe, carrying a felt for receiving water squeezed from a wet paper web, and pressed under high pressure when it approaches the press roll; wherein water drain grooves are provided in the machine direction (MD) in the surface of the felt side of the shoe press belt for papermaking, the cross-section in the cross-machine direction (CMD) of the water drain grooves is in the shape of a trapezoid, the groove corner parts formed by the flat groove sidewalls and the flat groove bottom part of the water drain grooves are chamfered by one or more flat surfaces.

(2) A shoe press belt according to (1); wherein the groove corner parts formed by the flat groove sidewalls and the flat land parts of the water drain grooves are further chamfered by one or more flat surfaces or one or more curved surfaces.

(3) A shoe press belt according to (1) or (2); wherein the groove corner parts formed by the flat groove sidewalls and the flat land parts and/or the groove corner parts formed by the flat groove sidewalls and the flat groove bottom part are chamfered by two or more flat surfaces.

(4) A shoe press belt for papermaking disposed between a press roll and a shoe, carrying a felt for receiving water squeezed from a wet paper web, and pressed under high pressure when it approaches the press roll; wherein water drain grooves are provided in the machine direction (MD) in the surface of the felt side of the shoe press belt for papermaking, the cross-section in the cross-machine direction (CMD) of the water drain grooves is in the shape of a rectangle, the groove corner parts formed by the flat groove sidewalls and the flat groove bottom part of the water drain grooves are chamfered by one or more flat surfaces.

(5) A shoe press belt according to (4); wherein the groove corner parts formed by the flat groove sidewalls and the flat land parts of the water drain grooves are further chamfered by one or more flat surfaces or one or more curved surfaces.

(6) A shoe press belt according to (4) or (5); wherein the corner parts formed by the flat groove sidewalls and the flat land parts and/or the groove corner parts formed by the flat groove sidewalls and the flat groove bottom part are chamfered by two or more flat surfaces.

(7) A shoe press belt according to any one of (1) to (6), wherein the water drain grooves are provided by cutting with the cutting blade which shape corresponds to the shape of the cross-section in the cross-machine direction (CMD) of the water drain grooves.

(8) A process for manufacturing the a shoe press belt, comprising; preparing a flat belt which comprises a resin layer at its felt side surface, cutting water drain grooves, in the machine direction (MD) in the surface of the felt side of the belt with a cutting blade to obtain the shoe press belt, and wherein the cross-section in the cross-machine direction (CMD) of the water drain grooves is in the shape of a trapezoid or a rectangle, and the groove corner parts formed by the flat groove sidewalls and the flat groove bottom part of the water drain grooves are chamfered by one or more flat surfaces.

(9) A process for manufacturing the shoe press belt according to (8), wherein the cutting blade has the shape corresponds to the shape of the cross-section in the cross-machine direction (CMD) of the water drain grooves.

Advantageous Effects of Invention

According to the present invention, it is possible to provide a belt (shoe press belt) for papermaking machines having excellent water draining properties, wherein, by forming the cross-section in the cross-machine direction (CMD) of the water drain grooves provided in the machine direction (MD) in the felt-side surface of the shoe press belt in the shape of a trapezoid or a rectangle and by chamfering the water drain groove sidewalls and the groove bottom part with one or more flat surfaces, the occurrence of cracks in the groove bottom corner parts during use is reduced, and wherein the cutter life is long and the surface roughness is small because abrasion between cutting chips cutter and groove sidewalls, occurring during groove machining, is reduced. Moreover, by chamfering the water drain groove sidewalls and the land parts with one or more flat surfaces or curved surfaces, the cracks occurring during use in the groove top corner parts are reduced, and the volume reduction occurring when a compression load is applied can also be prevented.

DESCRIPTION OF EMBODIMENTS

Embodiments of the present invention will be explained with reference to the drawings.

Figure 1:
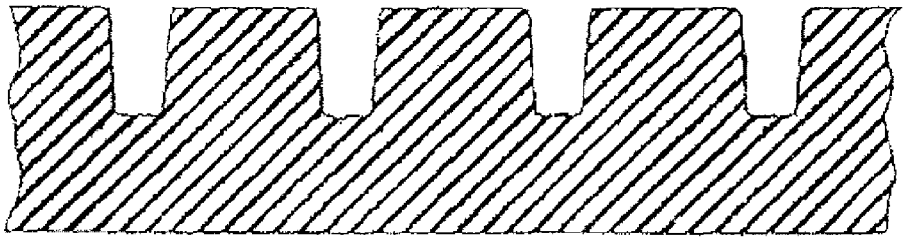
FIG. 1 is a view showing a conventional shoe press belt.
Figure 2:
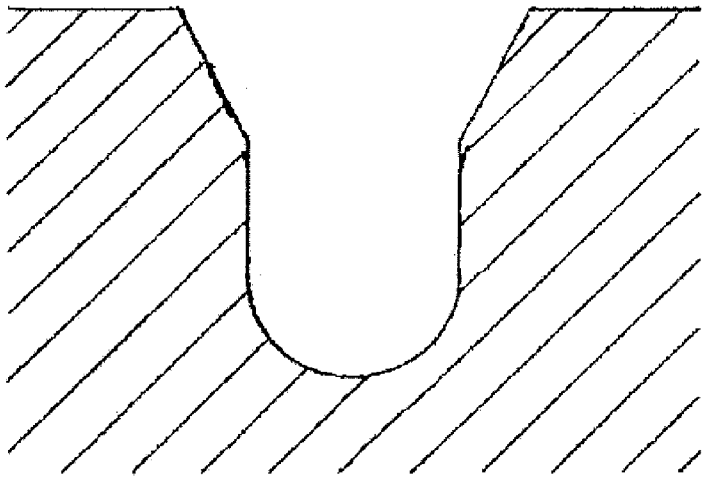
FIG. 2 is a view showing another conventional shoe press belt.
Figure 3:
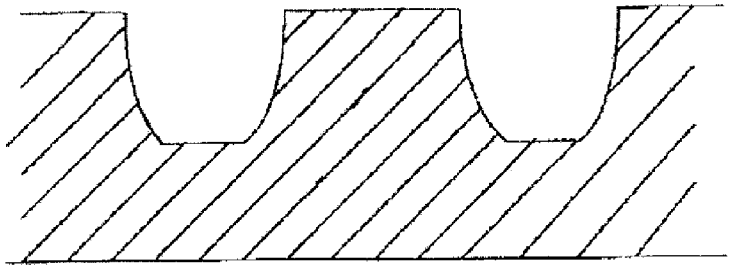
FIG. 3 is a view showing still another conventional shoe press belt.
Figure 4:
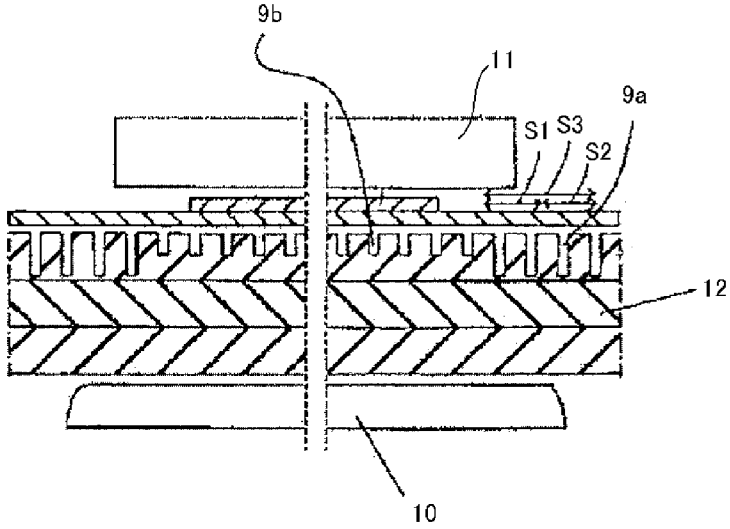
FIG. 4 is a view showing yet another conventional shoe press belt.
Figure 5:
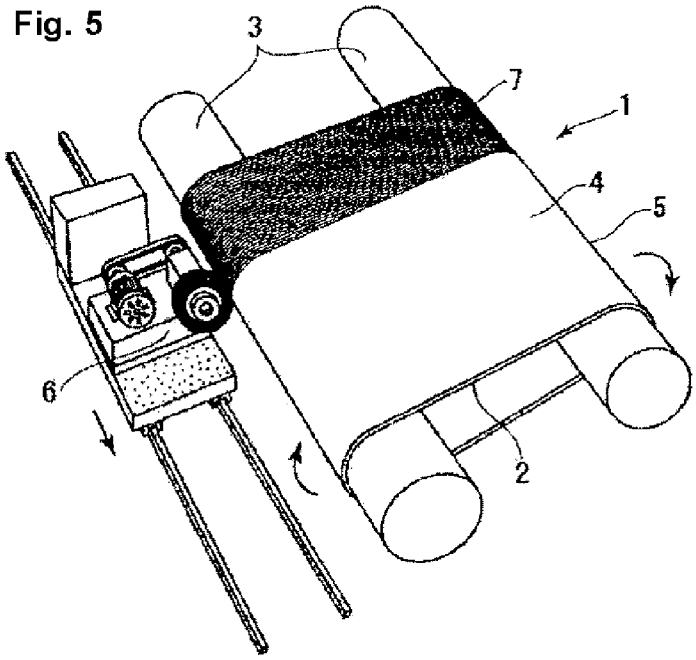
FIG. 5 is a groove cutting device for forming water drain grooves of a shoe press belt according to the present invention.

FIG. 5 is a schematic view of a device 1 for forming (cutting) water drain grooves of a papermaking shoe press belt according to the present invention.

Firstly, an endless substrate 2 is hanged over two rolls 3, 3 and stretched at a prescribed tension. The rolls 3 are rotatable, and the substrate 2 travels in the rotational direction of the roll 3. Under these conditions, a polyurethane layer is formed over the entire circumference of the substrate 2 by applying liquid polyurethane from above the substrate 2 and by curing. Thereafter, water drain grooves 7 are formed in the outer circumferential surface 5 of the substrate 2 on which a polyurethane layer 4 is provided by using a groove cutting device 6.

Moreover, the cross-section in the cross-machine direction (CMD) of the water drain grooves provided in the machine direction (MD) are in the shape of a trapezoid or a rectangle wherein the groove bottom part and the groove sidewalls are in the shape of a flat surface. Of the two parallel sides in the shape of the trapezoid, the longer side was placed at the surface side of the shoe press belt, whereas the shorter side was placed at the groove bottom part. The groove bottom corner parts formed by the flat groove sidewalls and the flat groove bottom part of the water drain grooves are chamfered by one or more flat surfaces. Furthermore, the groove top corner parts formed by the flat groove sidewalls and the flat land parts of the water drain grooves may be chamfered by one or more flat surfaces or by one or more curved surfaces. The term "land parts" means a region of the felt side main surface of the shoe press belt, which the water drain grooves are not provided.

According to the present invention, the water drain grooves provided in the machine direction (MD) have a cross-section in the cross-machine direction (CMD) in the shape of a trapezoid or a rectangle wherein the groove bottom part and the groove sidewalls are in the shape of flat surfaces; by chamfering the groove bottom corner parts where these two surfaces are connected by one or more flat surface(s), damage to the groove bottom corner parts can be prevented; therefore, the occurrence of cracks during use can be reduced. Moreover, the water flow resistance is reduced due to smaller friction and abrasion between the cutting chips the cutter and the sidewalls, occurring during cutting, and due to less surface roughness of the water drain grooves; therefore, the wet paper web water squeezing capability is improved, the cutter life is increased due to the reduced abrasion of the groove cutting blade during machining, and the productivity of the shoe press belt is improved.

The number of the flat surfaces used in chamfering the groove bottom corner parts is preferably, 2 or more, more preferably, 2 to 4, further preferably, 2.

Furthermore, the cross-section in the cross-machine direction (CMD) of the chamfered groove bottom corner parts is, but not limited to, preferably in the shape of concave.

Furthermore, damage to the groove top corner parts is prevented by chamfering the groove top corner parts connecting the surfaces of the flat groove sidewalls and land part of the water drain grooves with one or more flat surface(s) or with one or more curved surface(s); therefore, cracks occurring during use are reduced, and the reduction of the volume occurring when a compression load is applied can be prevented.

The number of the flat surfaces used in chamfering the groove top corner parts is preferably, 2 or more, more preferably, 2 to 4, further preferably, 2.

The cross-section in the cross-machine direction (CMD) of the chamfered groove top corner parts is, but not limited to, preferably in the shape of concave.

According to the present invention, the groove dimensions are adjusted in the ranges of: 0.5 to 2 mm groove width, 0.5 to 2 mm groove depth and 1 to 5 mm land part width i.e. the distance between adjacent water drain grooves.

EXAMPLES

Specifically, shoe press belts according to the present invention were made for Examples 1 to 14 and Comparative Examples 1 to 4 by the processes described hereinafter.

Process 1: an endless substrate was hanged over 2 rolls and stretched at a prescribed tension.

Process 2: a resin layer (polyurethane layer) was formed on the shoe side of the substrate by applying liquid polyurethane from above the substrate and by curing.

Process 3: after inversing the sides of the substrate, a resin layer (polyurethane layer) was then formed on the felt side of the substrate by applying liquid polyurethane from above the substrate and by curing, whereupon a shoe press belt having a substrate with resin layers on the front and the rear was obtained.

Process 4: a suitable cutting blade shape was selected in the groove cutting device, the point of the cutting blade was brought into contact with the felt-side surface of the shoe press belt, and prescribed water drain grooves were formed in the felt-side surface.

The groove shapes according to the invention were prepared as follows:

(1) Groove width: uniformly 1.0 mm (2) Groove depth: so as to reach 1.0 mm in the deep part of the groove (3) Land part width i.e. the distance between adjacent water drain grooves in the cross-machine direction (CMD): uniformly 1.54 mm The configurations of the cross-section formed in the cross-machine direction (CMD) are given in Table 1 as examples and in Tables 2 and 3 as drawings.

TABLE 1

| | Basic groove shape | Chamfering of land groove corner part (upper groove corner part) | Chamfering of groove bottom corner parts (lower groove corner part) |
|---|---|---|---|
| Example 1 | trapezoidal | none | 1 flat surface |
| Example 2 | trapezoidal | none | 2 flat surfaces, concave |
| Example 3 | trapezoidal | none | 2 flat surfaces, convex |

TABLE 1-continued

| | Basic groove shape | Chamfering of land groove corner part (upper groove corner part) | Chamfering of groove bottom corner parts (lower groove corner part) |
|---|---|---|---|
| Example 4 | trapezoidal | 1 flat surface | 1 flat surface |
| Example 5 | trapezoidal | 2 flat surfaces, concave | 2 flat surfaces, concave |
| Example 6 | trapezoidal | 2 flat surfaces, concave | 2 flat surfaces, convex |
| Example 7 | trapezoidal | 1 curved surface, concave | 1 flat surface |
| Comparative Example 1 | trapezoidal | none | none |
| Comparative Example 2 | trapezoidal | none | 1 curved surface, concave |
| Example 8 | rectangular | none | 1 flat surface |
| Example 9 | rectangular | none | 2 flat surfaces, concave |
| Example 10 | rectangular | none | 2 flat surfaces, convex |
| Example 11 | rectangular | 1 flat surface | 1 flat surface |
| Example 12 | rectangular | 2 flat surfaces, concave | 2 flat surfaces, concave |
| Example 13 | rectangular | 2 flat surfaces, concave | 2 flat surfaces, convex |
| Example 14 | rectangular | 1 curved surface, concave | 1 flat surface |
| Comparative Example 3 | rectangular | none | none |
| Comparative Example 4 | rectangular | none | 1 curved surface, concave |

TABLE 2

Table 2

Example 1

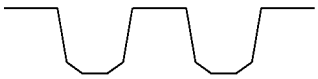

Example 2

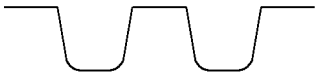

Example 3

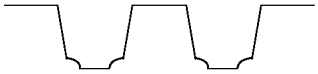

Example 4

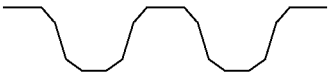

Example 5

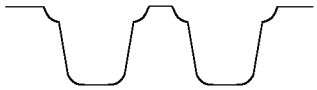

Example 6

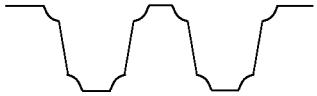

Example 7

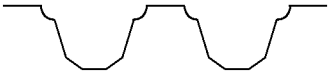

Comparative Example 1

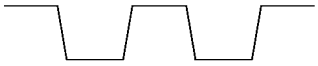

Comparative Example 2

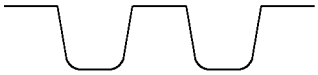

TABLE 3

Table 3

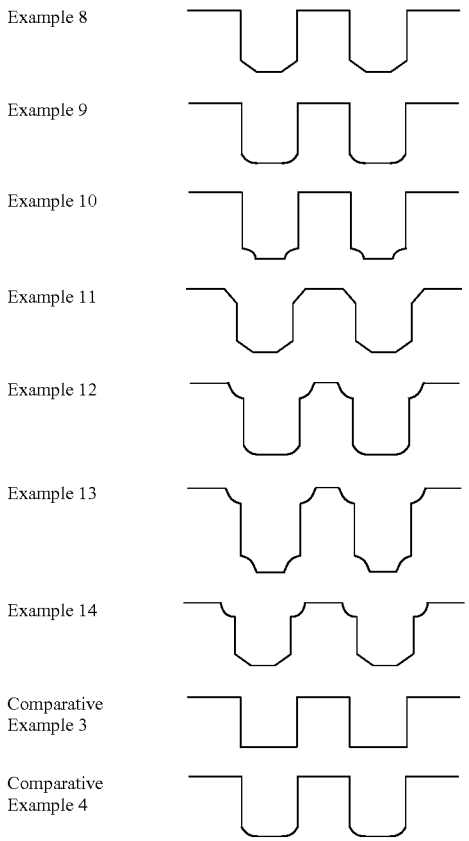

Performance Evaluation Method

Performance was evaluated by conducting the tests described below with the shoe press belts that were manufactured, and an overall evaluation was made by establishing a ranking.

Crack Test

Figure 6:
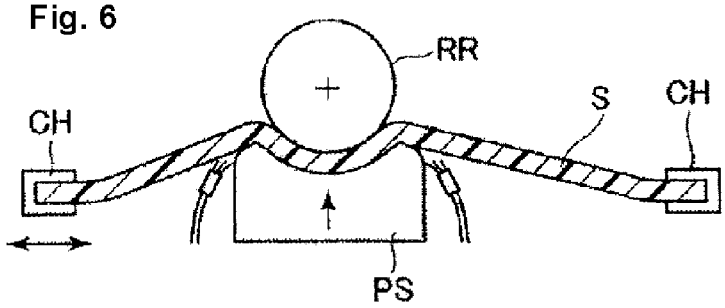
FIG. 6 is a view showing a device used for the crack test.

The device shown in FIG. 6 was used. In this device, both ends of a specimen S are sandwiched by cramp hands CH, CH; the cramp hands CH, CH are configured so that they can move back and forth in the left/right directions in unison. Moreover, the tension applied on the specimen S was 3 kg/cm and the speed of the back and forth movement was 40 cm/sec. The specimen S was pressed by the press roll RR and the press shoe PS. Then, the specimen S was pressed by the displacement of the press shoe PS in the direction of the press roll RR. The pressing force was 36 kg/cm$^2$. With this device, the frequency of the back and forth movements until cracks occur was measured. Moreover, the dimensions of the specimen were 400 mm in the machine direction (MD) (equal to the distance between the cramp hands CH, CH), and 50 mm in the cross-machine direction (CMD). Furthermore, the evaluation surface (felt-side surface) of the specimen S was the side facing the press roll RR.

The frequency until cracks occur was:

Evaluation score A: 400,000 times or more,

Evaluation score B: in the range of 200,000 to 400,000 times,

Evaluation score C: 200,000 times or less.

Water Squeezing Test

Figure 7:
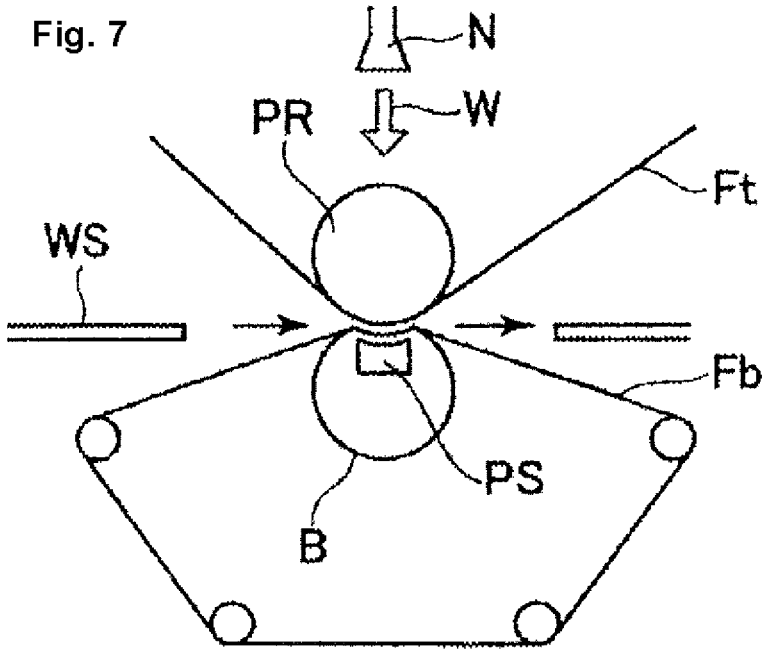
FIG. 7 is a schematic view of the water squeezing test.

The wet paper web water squeezing test was performed by using the device shown in FIG. 7. In the present test device, the belt B was placed in a position facing the press roll PR and the press shoe PS was placed in the internal periphery of said belt so as to press the belt B against the press roll PR. Furthermore, a top-side felt and a bottom-side felt F, both of which were made by flocking a staple fiber of 11 dtex nylon 6 on a base fabric by needle punching so as to obtain a basis weight of 1500 g/m$^2$, were placed between the press roll PR and the belt B. Then the belt B was made to travel at a speed of 1000 m/min. under a nip pressure of 1000 kN/m between the press roll PR and the press shoe PS. After which a water flow W was ejected from a nozzle N installed above the press roll PR at a pressure of 3 kg/cm$^2$ and a rate of 15 liters/min. At that time, the top roll was covered by a film from the water flow W, and after penetrating the top-side felt Ft and the bottom-side felt Fb, the water flow W also reached the belt B. Under such conditions, a wet paper sheet WS having 70% moisture content was placed on the bottom-side felt Fb and passed through the nip; after passing the nip, the moisture content of the wet paper sheet WS was measured.

The wet paper web moisture content was:

Evaluation score A: 45% or less,

Evaluation score B: in the range of 45% to 50%,

Evaluation score C: 50% or more.

Surface Roughness

The mean value of the arithmetic mean roughness standardized by the Japanese Industrial Standard (JIS-B0601) of the two groove sidewalls after cutting was measured.

The arithmetic mean roughness (Ra) was:

Evaluation score A: 2 mm or less.

Evaluation score B: in the range of 2 mm to 3 mm

Evaluation score C: 3 mm or less.

Cutter Life

The cutter life means the MD length of the groove cut with the brand-new commercially-available cutter until its cutting blade is damaged.

Evaluation score A: 3000 m or more

Evaluation score B: in the range of 2000 m to 3000 m

Evaluation score C: 2000 m or less.

Ranking

Regarding the test results, the overall evaluation was conducted based on the respective evaluation scores of the above tests, and the ranking was attributed as follows:

All evaluation scores were A: Ranking 1

Three evaluation scores were A and the others were B: Ranking 2

Two evaluation scores were A and the others were B: Ranking 3

One evaluation score was A and the others were B: Ranking 4

All evaluation scores were B: Ranking 5

One of the evaluation scores was C: Ranking 6

Regarding the shoe press belts relating to Examples 1 to 14 and Comparative Examples 1 to 4, the crack test, water squeezing test, surface roughness test and cutter life were conducted and the performance was evaluated. The results are shown in Table 4.

TABLE 4

| | Cracking properties | Water squeezing capability | Surface roughness | Cutter life | Ranking |
|---|---|---|---|---|---|
| Example 1 | B | B | B | A | 4 |
| Example 2 | B | B | A | A | 3 |
| Example 3 | B | B | B | A | 4 |
| Example 4 | B | A | B | A | 3 |
| Example 5 | A | A | A | A | 1 |

TABLE 4-continued

| | Cracking properties | Water squeezing capability | Surface roughness | Cutter life | Ranking |
|---|---|---|---|---|---|
| Example 6 | A | B | B | B | 4 |
| Example 7 | B | A | B | A | 3 |
| Comparative Example 1 | C | B | B | B | 6 |
| Comparative Example 2 | A | B | C | C | 6 |
| Example 8 | B | B | B | B | 5 |
| Example 9 | B | B | B | A | 4 |
| Example 10 | B | B | B | B | 5 |
| Example 11 | B | A | B | B | 4 |
| Example 12 | A | A | B | A | 2 |
| Example 13 | A | B | B | B | 4 |
| Example 14 | B | A | B | B | 4 |
| Comparative Example 3 | C | C | C | B | 6 |
| Comparative Example 4 | A | C | C | C | 6 |

According to the results of Table 4, the groove shape in Example 5, in which chamfering was performed on the lower groove corner parts formed by the groove side walls and the groove bottom part and the upper groove corner parts formed by the groove sidewalls and the land part, obtained good evaluation scores in all of the four evaluation tests and had the best balance of properties.

Compared to Example 5, the other Examples had inferior evaluations; however, compared to the Comparative Examples 1, 2, 3 and 4, which had no chamfering or which had rounded groove bottom corner parts, the Examples had good rankings.

INDUSTRIAL APPLICABILITY

According to the present invention, it is possible to make a shoe press belt having good water draining capacity in which the occurrence of cracks during use is reduced, and which is therefore extremely useful as shoe press belt used for improving the water squeezing capability from a wet paper web and a felt in the press part of a papermaking machine or a similar machine; and wherein, cutting chips, occurring during cutting, are few and the abrasion between the cutting chips, the cutter and the sidewalls is small because the groove sidewalls and groove bottom surface are flat surfaces; therefore, the cutter life is long, which makes the shoe press belt also good to manufacture.

REFERENCE SIGNS LIST

1: Water drain groove forming device
2: Substrate
3: Roll
4: Polyurethane layer
5: Outer circumferential surface
6: Groove cutting device
7: Water drain grooves
S: Specimen
CH: Cramp hand
PR: Press roll
PS: Press shoe
B: Belt
N: Nozzle
W: Water flow
Ft: Top-side felt
Fb: Bottom-side felt
WS: Wet paper web sheet

The invention claimed is:

1. A shoe press belt for papermaking disposed between a press roll and a shoe, carrying a felt for receiving water squeezed from a wet paper web, and pressed under high pressure when it approaches the press roll, the shoe press belt comprising:

water drain grooves on a surface of a felt side of the shoe press belt, each of the water drain grooves including flat groove sidewalls and a flat groove bottom part, the water drain grooves being provided in a machine direction (MD), a cross-section in a cross-machine direction (CMD) of the water drain grooves has a trapezoid shape, and the water drain grooves include lower groove corner parts formed by the flat groove sidewalls and the flat groove bottom part of the water drain grooves, the lower groove corner parts being chamfered to a concave form by two or more flat surfaces.

2. A shoe press belt according to claim 1, further comprising flat land parts disposed between the water drain grooves on the surface of the felt side of the shoe press belt, wherein the water drain grooves include upper groove corner parts formed by the flat groove sidewalls and the flat land parts of the water drain grooves, the upper groove corner parts being chamfered by one or more flat surfaces or one or more curved surfaces.

3. A shoe press belt according to claim 2, wherein the upper groove corner parts formed by the flat groove sidewalls and the flat land parts are chamfered by two or more flat surfaces.

4. A shoe press belt according to claim 3, wherein the water drain grooves are formed on the shoe press belt by cutting via a cutting blade, the cutting blade including a shape that corresponds to the cross-section in the cross-machine direction (CMD) of the water drain grooves.

5. A shoe press belt according to claim 2, wherein the water drain grooves are formed on the shoe press belt by cutting via a cutting blade, the cutting blade including a shape that corresponds to the cross-section in the cross-machine direction (CMD) of the water drain grooves.

6. A shoe press belt according to claim 1, further comprising flat land parts disposed between the water drain grooves on the surface of the felt side of the shoe press belt, wherein the water drain grooves include upper groove corner parts formed by the flat groove sidewalls and the flat land parts, the upper groove corner parts being chamfered by two or more flat surfaces.

7. A shoe press belt according to claim 6, wherein the water drain grooves are formed on the shoe press belt by cutting via a cutting blade, the cutting blade including a shape that corresponds to the cross-section in the cross-machine direction (CMD) of the water drain grooves.

8. A shoe press belt according to claim 1, wherein the water drain grooves are formed on the shoe press belt by cutting via a cutting blade, the cutting blade including a shape that corresponds to the cross-section in the cross-machine direction (CMD) of the water drain grooves.

* * * * *